US008878397B2

(12) United States Patent
Tracey

(10) Patent No.: US 8,878,397 B2
(45) Date of Patent: Nov. 4, 2014

(54) ELECTRICAL CORD REEL WITH CONTROL SYSTEM TO LIMIT OVERHEATING

(75) Inventor: James B. A. Tracey, Austin, TX (US)

(73) Assignee: Great Stuff, Inc., Austin, TX (US)

( * ) Notice: Subject to any disclaimer, the term of this patent is extended or adjusted under 35 U.S.C. 154(b) by 578 days.

(21) Appl. No.: 13/216,673

(22) Filed: Aug. 24, 2011

(65) Prior Publication Data

US 2012/0049653 A1 Mar. 1, 2012

Related U.S. Application Data

(60) Provisional application No. 61/378,861, filed on Aug. 31, 2010.

(51) Int. Cl.
*H01B 7/30* (2006.01)

(52) U.S. Cl.
USPC ..... 307/147

(58) Field of Classification Search
USPC ..... 307/147
See application file for complete search history.

(56) References Cited

U.S. PATENT DOCUMENTS

| | | | | |
|---|---|---|---|---|
| 5,101,082 | A | 3/1992 | Simmons et al. | |
| 5,600,306 | A | 2/1997 | Ichikawa et al. | |
| 5,841,617 | A | 11/1998 | Watkins, Jr. et al. | |
| 5,855,262 | A | 1/1999 | Jackson | |
| 7,419,038 | B2 * | 9/2008 | Caamano et al. | 191/12.2 R |
| 8,375,507 | B2 * | 2/2013 | Lee et al. | 15/323 |
| 2006/0266605 | A1 | 11/2006 | Caamano et al. | |
| 2011/0076879 | A1 | 3/2011 | Fleisig | |

FOREIGN PATENT DOCUMENTS

| | | | |
|---|---|---|---|
| DE | 765 071 | C | 5/1954 |
| EP | 1 884 307 | A1 | 2/2008 |
| JP | 4 322116 | A | 11/1992 |
| WO | WO 2006/094189 | A2 | 9/2006 |
| WO | WO 2009/091745 | A2 | 7/2009 |

OTHER PUBLICATIONS

Search Report and Written Opinion in PCT Application No. PCT/US2011/049227, dated Dec. 19, 2011.

* cited by examiner

*Primary Examiner* — Robert L. Deberadinis
(74) *Attorney, Agent, or Firm* — Knobbe, Martens, Olson & Bear LLP

(57) ABSTRACT

In an electrical cord reel, a rotatable member can rotate about a winding axis to spool and unspool a linear material. An input power connector can couple to an electrical power source. An output power connector on the rotatable member can couple to an electrical cord at least partially wound about the rotatable member. A switch is adjustable to allow or prevent electrical current flow from the input power connector to the output power connector. One or more temperature sensors detect temperature inside a housing enclosing the rotatable member, output power connector, and a fan. A control system activates the fan if the detected temperature rises from a level below a fan-activation threshold to a level above the fan-activation threshold but below a power shut-off threshold. The control system moves the switch to an open position if the detected temperature is greater than or equal to the power shut-off threshold.

13 Claims, 14 Drawing Sheets

ELECTRICAL CORD REEL WITH CONTROL SYSTEM TO LIMIT OVERHEATING

CLAIM FOR PRIORITY

The present application claims priority benefit under 35 U.S.C. §119(e) to Provisional Application No. 61/378,861, filed Aug. 31, 2010.

INCORPORATION BY REFERENCE

The present application incorporates by reference the entire disclosures of U.S. Pat. No. 7,320,843 to Harrington; U.S. Pat. No. 7,350,736 to Caamano et al.; U.S. Pat. No. 7,419,038 to Caamano et al.; U.S. Pat. No. 7,503,338 to Harrington et al.; and U.S. Pat. No. 7,533,843 to Caamano et al.; and U.S. patent application Publication No. 2008/0223951A1 to Tracey et al.

BACKGROUND

1. Field of the Invention

The present application relates generally to reels for spooling linear material, and specifically to the reduction and prevention of overheating of the spooled electrical cord and/or reel components.

2. Description of the Related Art

Components of an electrical cord reel can overheat in certain circumstances. For example, the flow of electrical current through an electrical cord wound on the reel typically causes heat to be dissipated. The heat dissipation can undesirably lead to damage (e.g., melting) of the cord insulation and core, as well as other reel components.

SUMMARY

In one embodiment, the present application provides an electrical cord reel comprising a rotatable member, an input power connector, an output power connector, a fan, a switch, a housing, a set of one or more temperature sensors, and a control system. The rotatable member is configured to rotate about a winding axis to spool and unspool a linear material about the rotatable member. The input power connector configured to be mechanically and electrically coupled to an electrical power source. The output power connector is on the rotatable member and is configured to be mechanically and electrically coupled to an electrical cord that is at least partially wound about the rotatable member. The reel is configured to convey electrical current from the input power connector to the output power connector. The switch has a closed position in which electrical current flows from the input power connector to the output power connector through the switch. The switch has an open position in which the switch prevents electrical current from flowing from the input power connector to the output power connector. The housing encloses the rotatable member, the output power connector, and the fan. The set of one or more temperature sensors is configured to detect temperature inside the housing. The control system is responsive to the temperature detected by the temperature sensor set. The control system is configured to activate the fan if the temperature detected by the temperature sensor set rises from a level below a fan-activation threshold to a level above the fan-activation threshold but below a power shut-off threshold, the power shut-off threshold being greater than the fan-activation threshold. The control system is configured to move the switch to its open position if the temperature detected by the temperature sensor set is greater than or equal to the power shut-off threshold.

In another embodiment, the present application provides a method including the following steps. A rotatable member configured to rotate about a winding axis to spool and unspool an electrical cord about the rotatable member is provided, wherein an end of the cord is electrically connected to the rotatable member. A housing enclosing the rotatable member is provided. Electrical current is conveyed from an electrical power source to the end of the cord, so that the current flows through the cord. A temperature within the housing is monitored. A rise of the monitored temperature from a level below a fan-activation threshold to a level above the fan-activation threshold but below a power shut-off threshold is responded to by activating a fan inside the housing, the power shut-off threshold being greater than the fan-activation threshold. A rise of the monitored temperature to a level greater than or equal to the power shut-off threshold is responded to by preventing current flow from the power source to the cord.

For purposes of summarizing the invention and the advantages achieved over the prior art, certain objects and advantages of the invention have been described herein above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught or suggested herein without necessarily achieving other objects or advantages as may be taught or suggested herein.

All of these embodiments are intended to be within the scope of the invention herein disclosed. These and other embodiments will become readily apparent to those skilled in the art from the following detailed description of the preferred embodiments having reference to the attached figures, the invention not being limited to any particular preferred embodiment(s) disclosed.

DETAILED DESCRIPTION OF THE PREFERRED EMBODIMENTS

Figure 1:
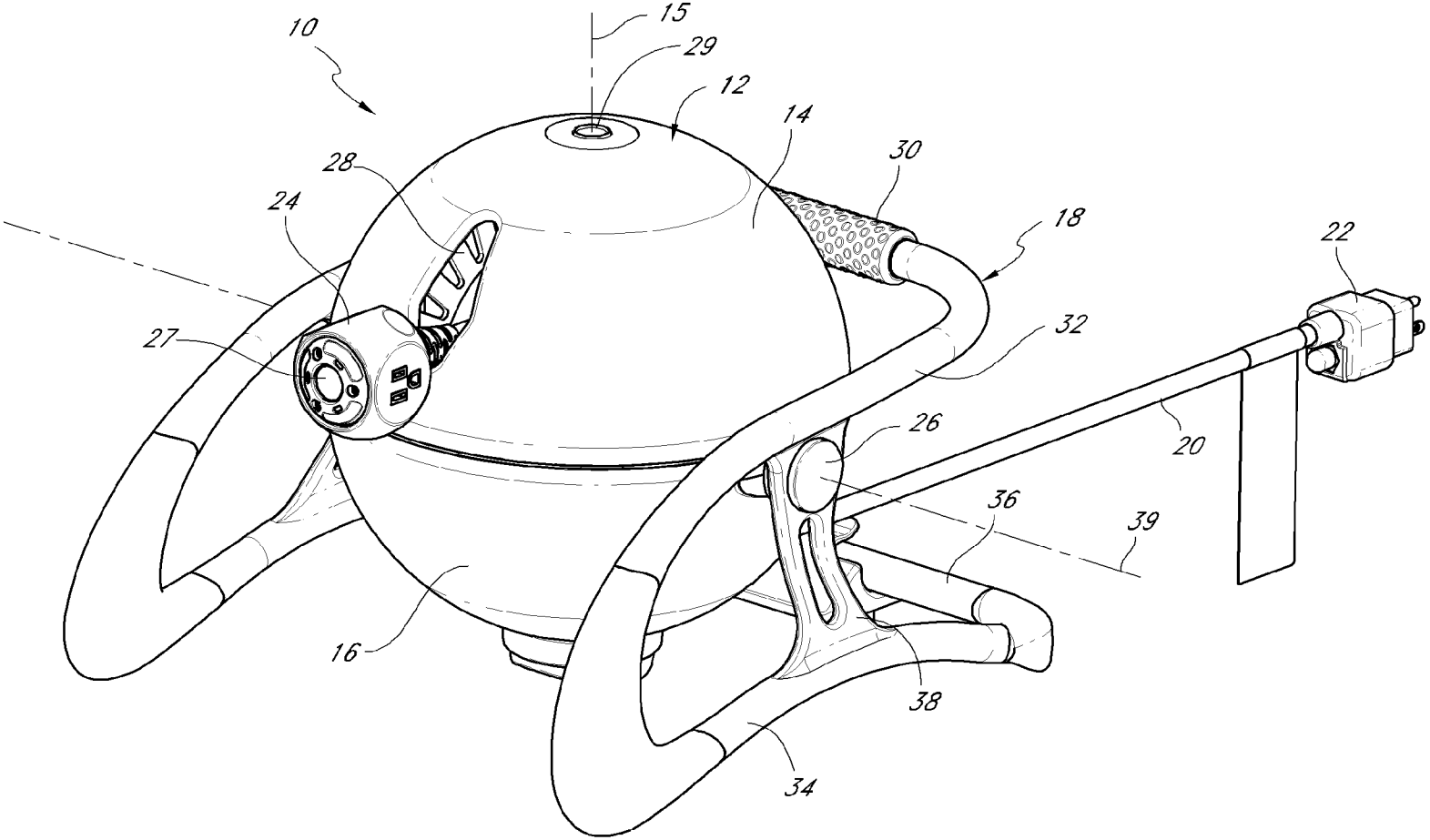
FIG. 1 is a front, right perspective view of an embodiment of an electrical cord reel.

FIG. 1 is a perspective view of an embodiment of an electrical cord reel 10. The reel 10 includes a housing 12 that substantially encloses various reel components. In the illustrated embodiment, the housing 12 is substantially spherical, but it will be understood that the housing can have other shapes. The illustrated housing 12 comprises an upper portion 14 and a lower portion 16, but it will be appreciated that the housing 12 can comprise more than two major portions. In the illustrated embodiment, each portion 14 and 16 is substantially semispherical. Preferably, the housing portions 14 and 16 are capable of rotating with respect to each other about a housing axis 15. Further details concerning such a housing 12, including structure to facilitate relative rotation between portions 14 and 16 about axis 15, are provided in U.S. Pat. No. 7,533,843 to Caamano et al.

The reel 10 preferably includes a support structure for supporting the reel with respect to a support surface, such as the ground, a tabletop, or even a wall or ceiling. A mounting element can be provided to secure the support structure with respect to a vertical wall or a ceiling. Examples of support structures and a compatible mounting element for mounting the reel to a wall or ceiling are provided in U.S. Pat. No. 7,419,038 to Caamano et al.

The illustrated reel 10 has a support structure 18 comprising a rear handle portion 30, a pair of side arm portions 32, a pair of side foot portions 34, and a rear foot portion 36. The side arm portions 32 and side foot portions 34 are positioned on opposing sides of the housing 12. The rear handle portion 30 may include a grip cover (e.g., formed of rubber) to make it easier to grip the portion 30. Also, the transitions between the arm portions 32 and the foot portions 34, as well as the transitions between the side foot portions 34 and the rear foot portion 36, can be enclosed within tubular covers (e.g., rubber covers) to reduce how much the support structure 18 gets scratched and scratches other surfaces, as well as to reduce the tendency of the reel 10 to slide upon a support surface. The support structure 12 can further include connections 38 between the side arm portions 32 and the side foot portions 34, to further rigidify the support structure 12. In some embodiments, the housing 12 is rotatably mounted to the support structure 12 at a pair of connections 26 on opposing sides of the housing, so that the housing 12 is configured to rotate at least partially with respect to the support structure 12 about a substantially horizontal axis 39 extending through connections 26.

The reel 10 can include an input electrical power cord 20 with an input power connector 22 (illustrated as a standard electrical plug) configured to be mechanically and electrically coupled to an electrical power source 50 (FIG. 3), such as a standard electrical outlet. It will be appreciated that the input power connector 22 need not be provided on an input cord 20. For example, the electrical power source 50 can comprise a battery or battery pack, and the input power connector 22 can comprise terminals for connection thereto. In such embodiments, the battery or battery pack may be enclosed within the housing 12. A suitable battery structure is disclosed in U.S. Pat. No. 7,320,843 to Harrington. It will be appreciated that the reel 10 can include a first input power connector for connecting to a battery, and a second input power connector 22 of an electrical cord 20.

Figure 2:
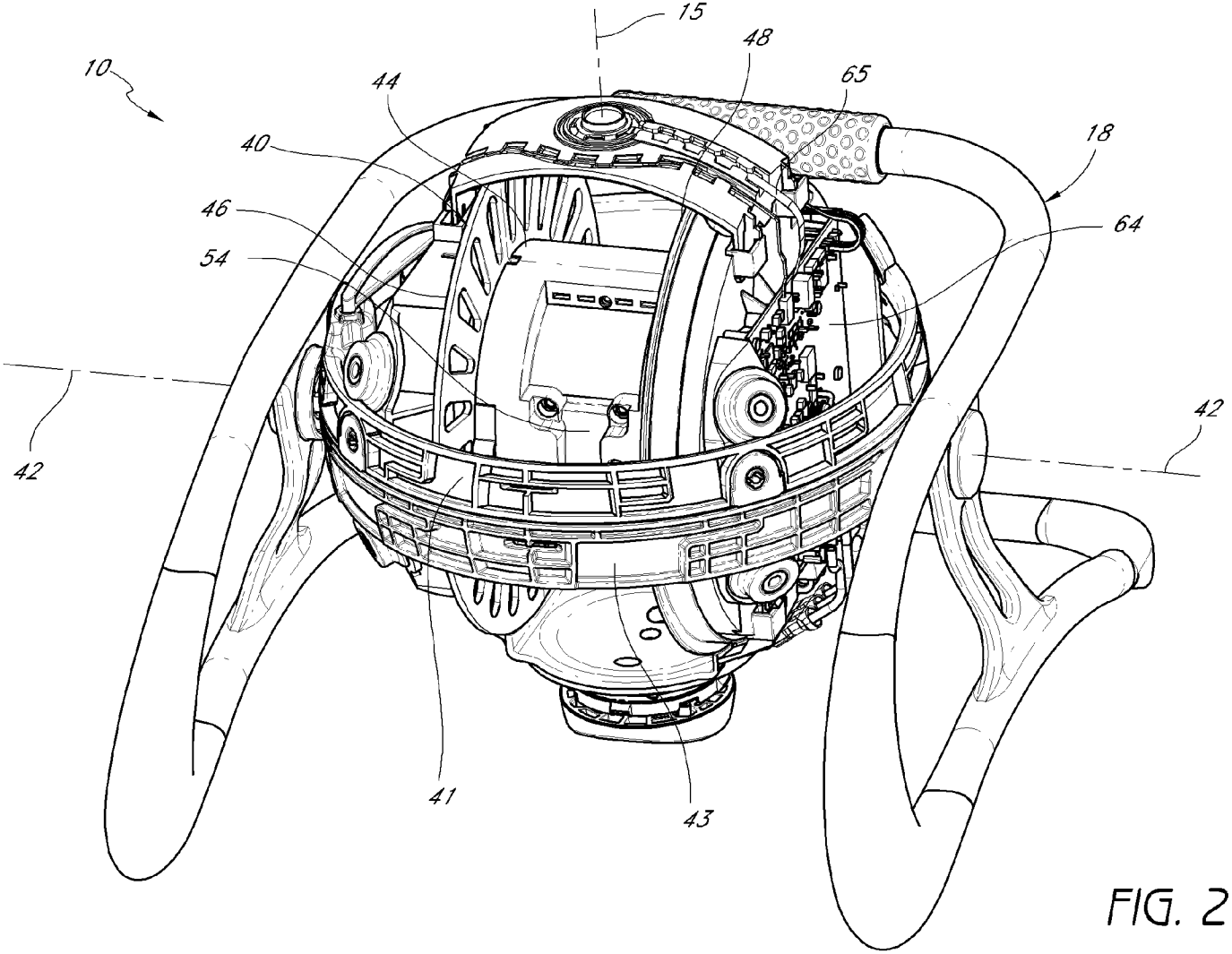
FIG. 2 is a front, right perspective view of the cord reel of FIG. 1, with the upper and lower housing portions removed to show internal components.
Figure 3:
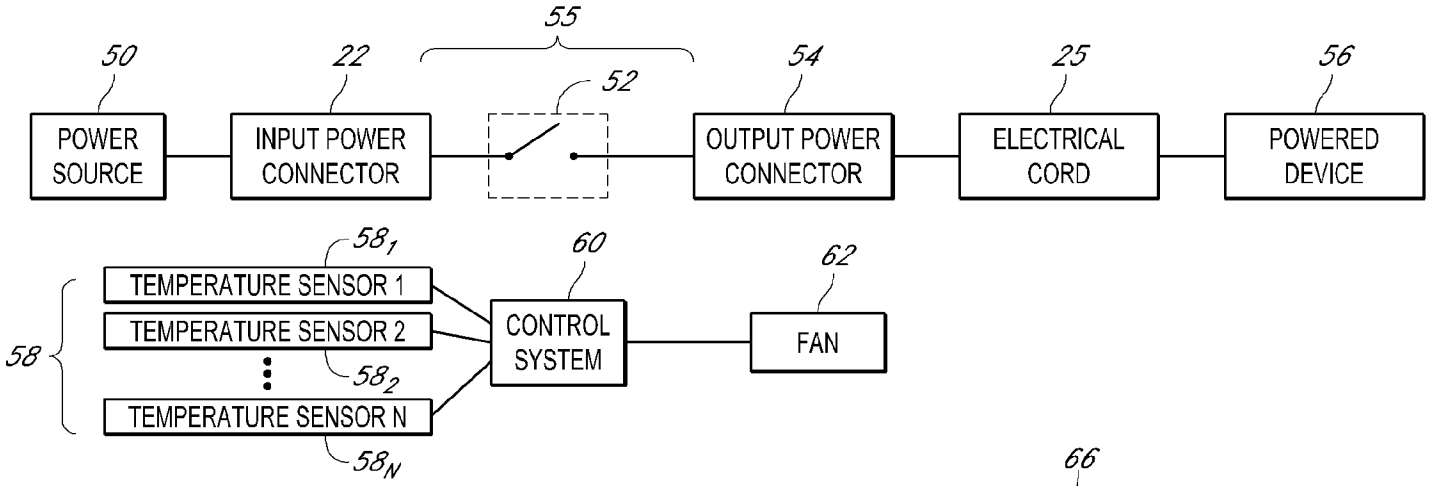
FIG. 3 is a schematic diagram illustrating electrical current flow and a temperature control system of an embodiment of a cord reel.

The reel 10 is configured to spool an output electrical cord 25 (FIG. 3). As will be described in further detail below, the reel 10 is configured to convey electrical current from the input power connector 22 to the output cord 25. The output cord 25 can include an end portion 24 with one or more terminals for mechanically and electrically coupling to power cords of devices 56 (FIG. 3) that will receive electrical power from the cord 25. The housing 12 preferably includes an aperture 28 through which the cord 25 may extend when partially wound about a rotatable member 40 (FIG. 2, described below) within the housing 12. In the illustrated embodiment, the aperture 28 is formed within the upper housing portion 14.

FIG. 2 shows the cord reel 10 with the upper housing portion 14 and lower housing portion 16 removed to reveal interior components. The illustrated reel 10 includes an upper circular rail 41 that attaches to the lower portion of the upper housing portion 14, and a lower circular rail 43 that attaches to the upper portion of the lower housing portion 16. The upper rail 41 and lower rail 43 (and their respective housing portions) preferably rotate with respect to one another about the housing axis 15, by employing wheels, ball bearings, or other elements to facilitate such rotation.

Figure 4:
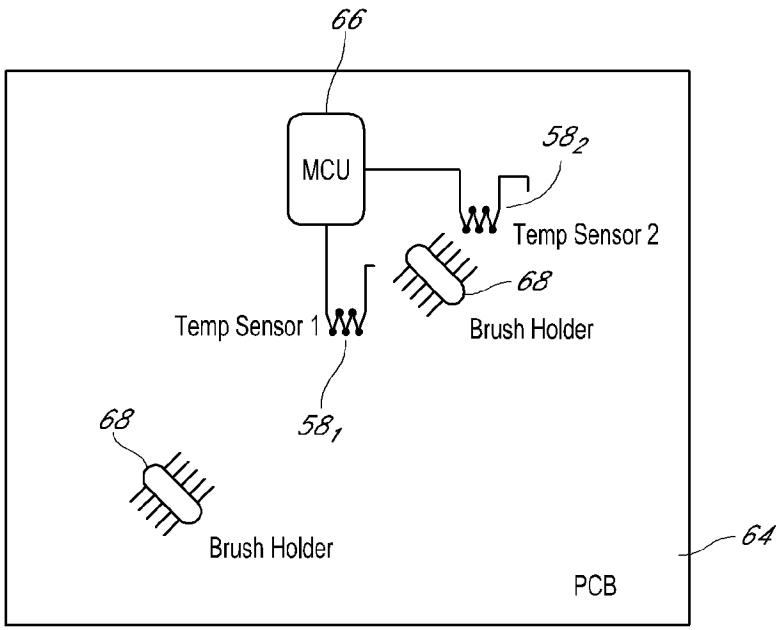
FIG. 4 is a schematic diagram of a circuit board of an embodiment of a temperature control system of a cord reel.

The housing 12 (FIG. 1) substantially encloses a rotatable member 40 configured to rotate about a winding axis 42 to spool and unspool an electrical cord 25 (or even other flexible linear materials) about the rotatable member 40. The housing 12 preferably encloses at least the rotatable member 40, the output power connector 54 (FIGS. 2, 2A, and 3), and a fan 62 (FIGS. 3, 6, and 7), and more preferably also a motor 78 (FIG. 8) and a set of one or more temperature sensors 58 (FIGS. 3 and 4). The winding axis 42 need not be collinear or parallel to the horizontal axis 39 (FIG. 1). In a preferred embodiment (described below), the rotatable member 40 and its winding axis 42 rotate about the housing axis 15 relative to the support structure 18 and lower housing portion 16. In the illustrated embodiment, the rotatable member 40 comprises a generally cylindrical drum 44 and a pair of circular plates 46 and 48 sandwiching the drum 44. It will be appreciated that the drum 44 need not be cylindrical.

In some embodiments, the reel 10 includes a reciprocating mechanism that causes the rotatable member 40 to rotate back and forth in a reciprocating fashion about the housing axis 15 (regardless of whether the housing portions 14 and 16 are configured to rotate with respect to one another about the axis 15) with respect to the portion of the housing 12 having the aperture 28 (in the illustrated embodiment, the upper housing portion 14). This reciprocating mechanism thereby promotes more uniform winding of the cord 25 onto the rotatable member 40. Preferably, the reciprocating mechanism only produces such reciprocating rotation of the rotatable member 40 about the axis 15 while the rotatable member 40 is rotating about the winding axis 42. An exemplary reciprocating mechanism is disclosed in U.S. Pat. No. 7,533,843 to Caamano et al.

Figure 2A:
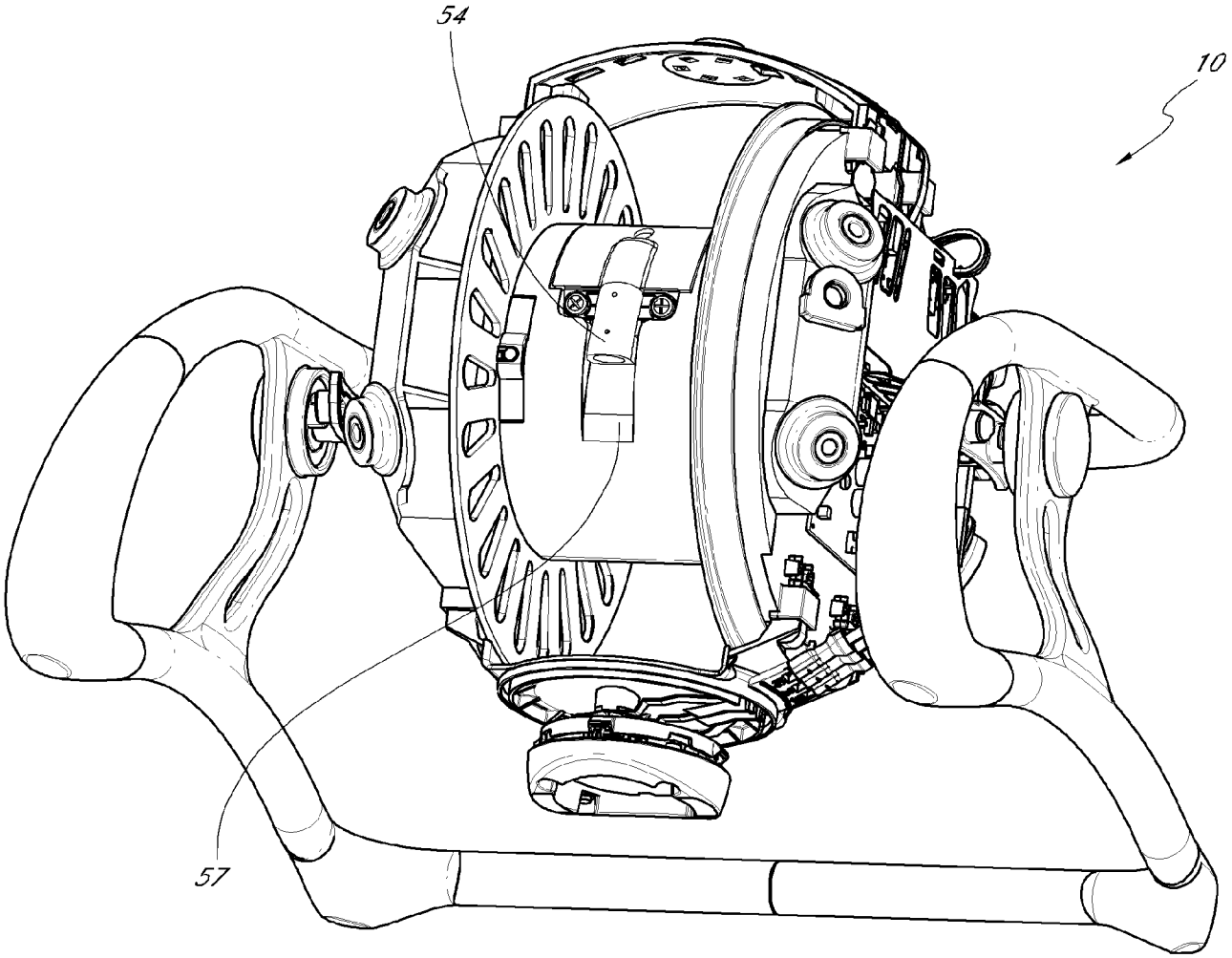
FIG. 2A is a bottom perspective view of the reel as shown in FIG. 2, with the upper and lower rails removed to show internal components more clearly.

Referring to FIGS. 2 and 2A, an output power connector 54 is preferably provided on the rotatable member 40. The output power connector 54 is preferably configured to be mechanically and electrically coupled to the output electrical cord 25. As will be further described below, the reel 10 is preferably configured to convey electrical current from the input power connector 22 (FIGS. 1 and 3) to the output power connector 54. In the figures, the bottom of the power connector 54 includes a terminal for connection with the output cord 25. Further, a recess (e.g., a sloped or ramped recess) 57 can be provided to accommodate a terminal portion of the output cord 25, so as to reduce an extent to which the connection of the cord 25 and the output power connector 54 produces a variation in the profile of the surface onto which the cord is spooled.

FIG. 3 is a schematic diagram illustrating electrical current flow and a temperature control system of an embodiment of a cord reel 10. The input power connector 22 is connected to an electrical power source 50. As noted above, the input power connector 22 can comprise an electrical plug, and the power source 50 can comprise a municipal power grid accessible by inserting the plug into an outlet. In another embodiment, the power source 50 can comprise a battery, and the input power connector 22 can comprise electrical contacts for connecting with the battery.

The reel 10 preferably includes an electrical pathway 55 for conveying electrical current from the input power connector 22 to the output power connector 54 and an output cord 25 connected to the output connector 54. The output cord 25 can be connected to a device 56 that is to be electrically powered by the power source 50. The electrical pathway 55 can comprise, for example, one or more wires and/or one or more current pathways on a printed circuit board (e.g., printed circuit board 64, shown in FIGS. 2, 2A, 4, 5, and 8 and described below). Preferably, the electrical pathway 55 comprises slip rings provided on one of the plates 46, 48 (FIG. 2), as well as brushes that contact the slip rings as the rotatable member 40 and plate rotate about the winding axis 42. In the illustrated embodiment, the plate 48 includes slip rings 80 (FIGS. 9 and 9A) in contact with brushes 82 (FIG. 10), as described in further detail below. It will be appreciated that part of the electrical pathway 55 can reside on or within the rotatable member 40.

The electrical pathway 55 preferably includes a switch 52 having a closed position in which electrical current flows from the input power connector 22 to the output power connector 54 through the switch 52. The switch 52 also has an open position in which the switch 52 prevents electrical current from flowing from the input power connector 22 to the output power connector 54. In a preferred embodiment, a control system 60 can control the position of switch 52.

The reel 10 (FIG. 1) can include a set of one or more temperature sensors 58 configured to detect temperature inside the housing 12 of the reel. In the illustrated embodiment, there are N temperature sensors $\mathbf{58}_1$ through $\mathbf{58}_N$. The reel 10 preferably also includes the control system 60 and a fan 62. The control system 60 can include, for example, a microchip 66 (FIG. 4) mounted on a printed circuit board 64, and the fan 62 can include fan blades and an electric motor that is electronically controllable by the control system 60. The control system 60 is preferably responsive to the temperature detected by the temperature sensor set 58. The control system 60 can be configured to activate the fan 62 if the temperature detected by the temperature sensor set 58 (also referred to herein as the "monitored temperature") rises from a level below a fan-activation threshold to a level above the fan-activation threshold but below a power shut-off threshold, the power shut-off threshold being greater than the fan-activation threshold. In this manner, the fan 62 helps to counteract the rising temperature inside the reel housing 12. The control system 60 can also be configured to move the switch 52 to its open position (thereby stopping any flow of electrical current to the output cord 25) if the temperature detected by the temperature sensor set 58 is greater than or equal to the power shut-off threshold. In this manner, the current flow is stopped if the temperature inside the housing 12 rises too high.

FIG. 4 is a schematic diagram of a circuit board 64 of an embodiment of a temperature control system 60. The illustrated circuit board 64 can comprise a printed circuit board as known in the art. A microchip 66 and temperature sensors $\mathbf{58}_1$ to $\mathbf{58}_N$ can be mounted on the circuit board 64. An example of a suitable microchip 66 is Part No. MSP430F22321DA (16-bit) from Texas Instruments Incorporated, although it will be understood that many different types of microchips can be used. The microchip 66 can operate with the internal PLL clock set at 16 MHz, for example. An example of a suitable temperature sensor 58 is an MCP9700 thermistor. In the illustrated embodiment, only two temperature sensors $\mathbf{58}_1$ and $\mathbf{58}_2$ are provided on the circuit board 64. The temperature sensors 58 preferably electrically communicate with the microchip 66.

As explained in further detail below with reference to FIG. 10, one or more brush holders 68 can also be mounted to the circuit board 64. The brush holders 68 hold brushes 82 that electrically contact the slip rings 80 (FIG. 9) while the rotatable element 40 is either at rest or rotating about the winding axis 42 (FIG. 2). In a preferred implementation, the temperature sensors 58 are positioned relatively close to the brush holders 68. In the illustrated embodiment, the temperature sensors $\mathbf{58}_1$ and $\mathbf{58}_2$ are flanked on opposite sides of one of the brush holders 68. This may be helpful because the brush holder locations, in some embodiments, tend to be hotter than other parts of the reel 10. In general, it is preferred to locate the temperature sensors 58 at positions that are likely to become hotter during operation, so that the cooling measures implemented by the control system 60 are more effective in preventing damage or injury caused by high temperature. It will be appreciated that each brush holder 68 can be flanked on two or more sides by temperature sensors 58.

Figure 5:
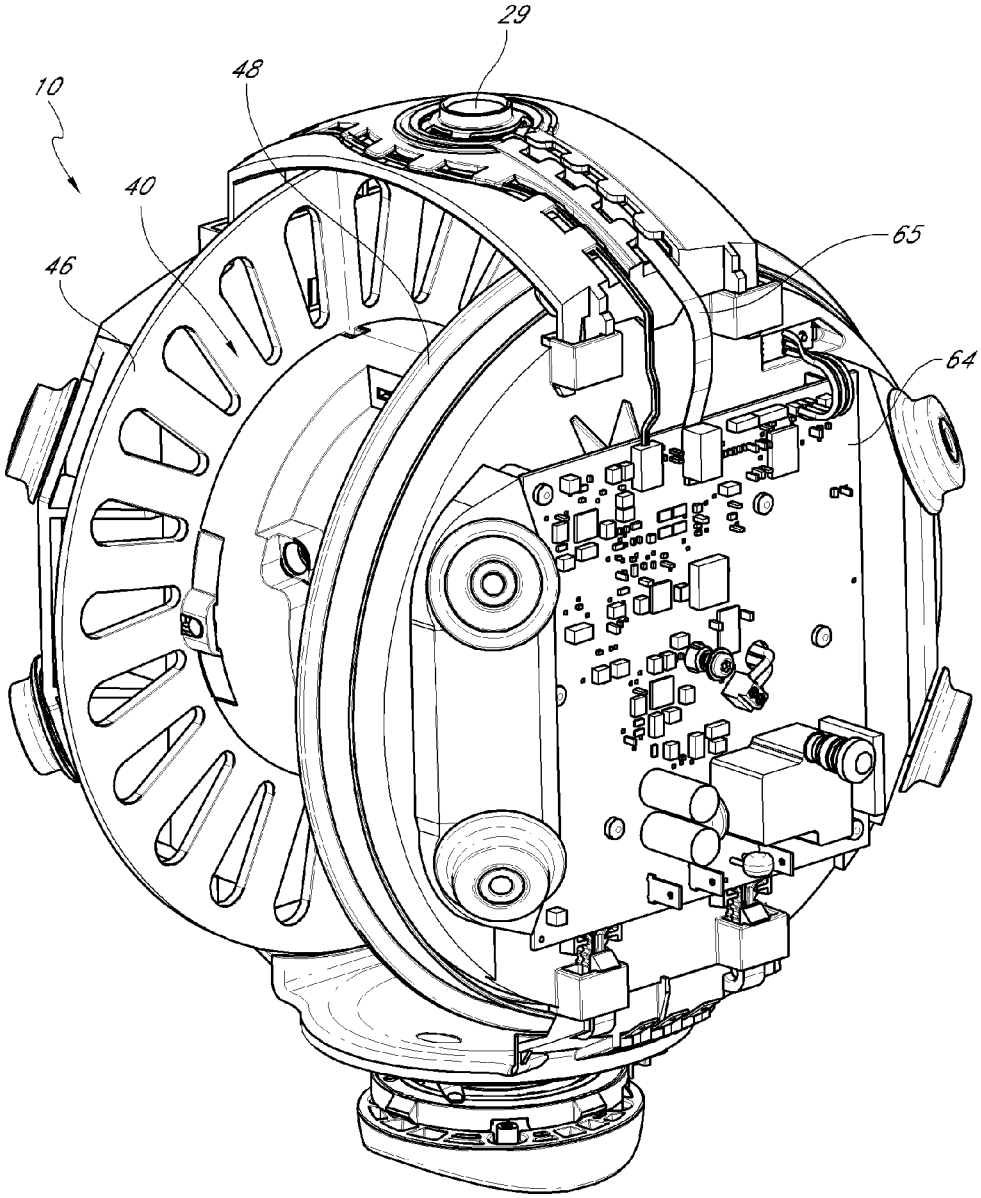
FIG. 5 is a front, right perspective view of the cord reel as shown in FIG. 2A, with the support structure removed to show internal components.
Figure 9:
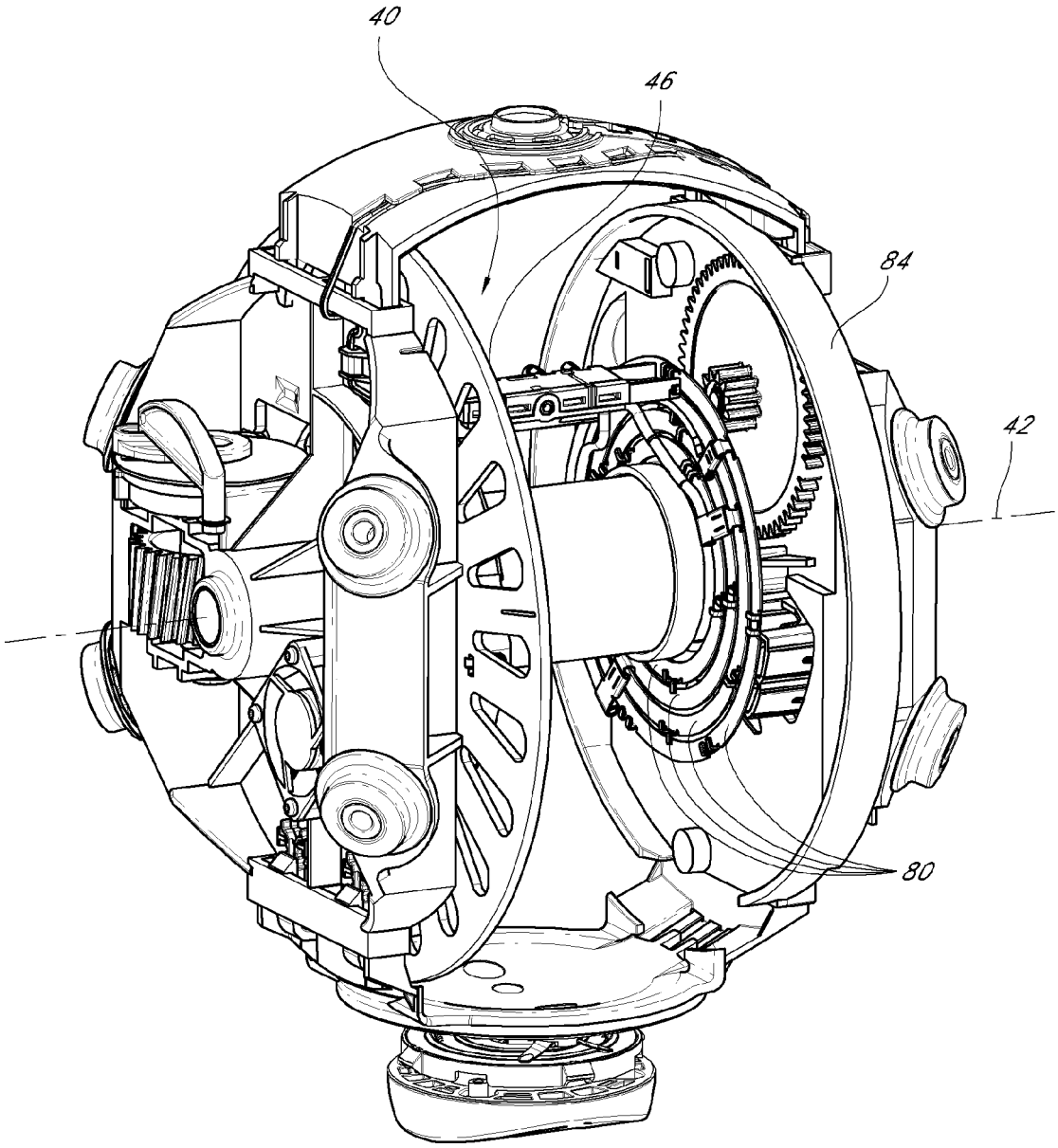
FIG. 9 is a front, left perspective view of the cord reel of FIG. 8.

FIG. 5 is a front, right perspective view of the cord reel 10 of FIGS. 1 and 2, with the support structure 18, upper housing portion 14, lower housing portion 16, upper rail 41, and lower rail 43 removed to show internal components more clearly. As shown in FIG. 5, the circuit board 64 can be mounted substantially parallel to the plate 48 of the rotatable element 40. This can facilitate electrical contact between the brushes 82 (FIG. 10) mounted to the circuit board 64 (e.g., via brush holders 68 shown in FIGS. 4 and 10) and the slip rings 80 (FIG. 9).

Figure 6:
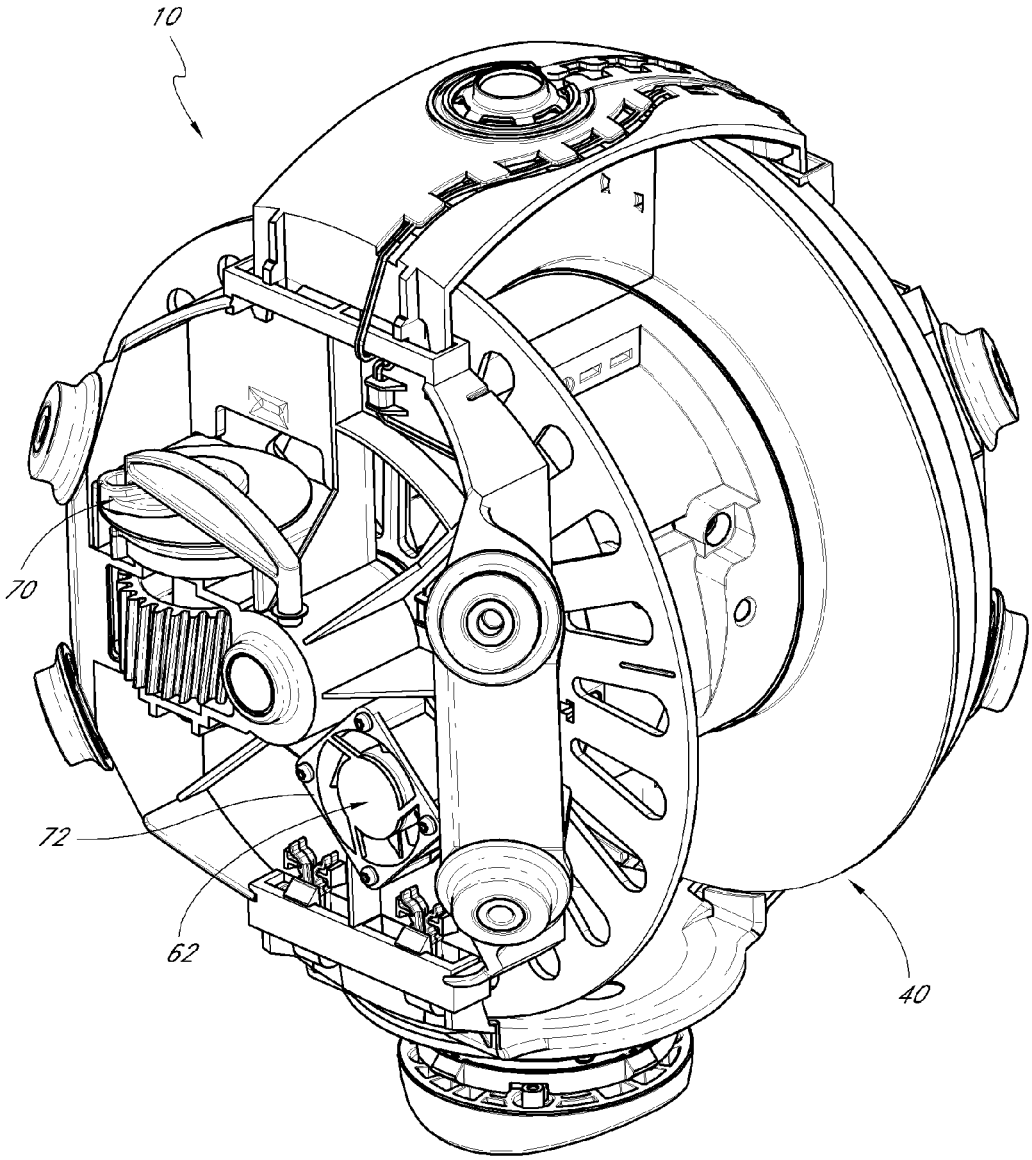
FIG. 6 is a front, left perspective view of the cord reel as shown in FIG. 5.
Figure 7:
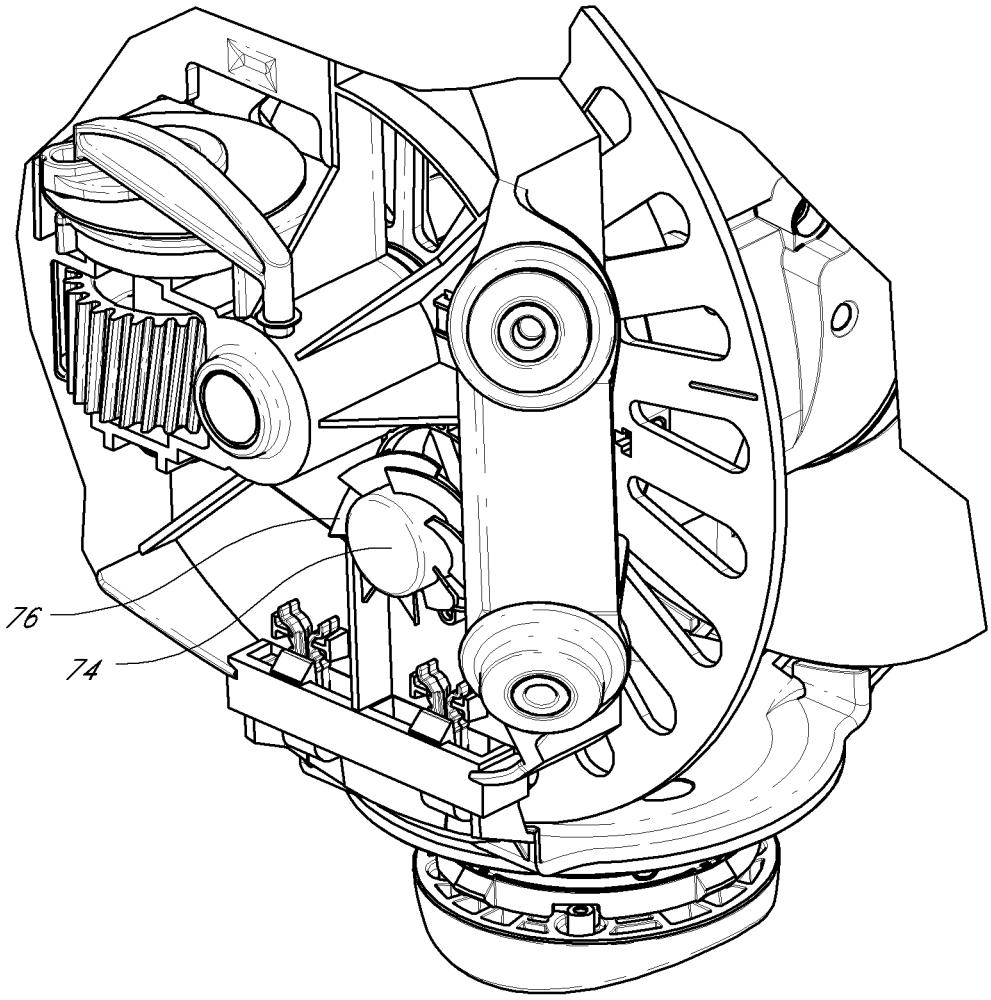
FIG. 7 is an exploded view of the cord reel as shown in FIG. 6, with the fan housing removed.

FIG. 6 is a front, left perspective view of the cord reel 10 of FIG. 5. In this embodiment, the fan 62 is mounted on a side of rotatable member 40 that is opposite to that of the circuit board 64. It will be understood that the fan 62 can be mounted in any of many different locations in a reel housing, but preferably where well suited to cool the more temperature-sensitive components of the reel The illustrated fan 62 includes a housing 72. FIG. 7 is an exploded view of the cord reel 10 as shown in FIG. 6, with the fan housing 72 removed to reveal a fan hub 74 and fan blades 76.

FIG. 6 also shows certain components 70 of a reciprocating mechanism as described above. Further details concerning the illustrated components 70 are provided in U.S. Pat. No. 7,533,843 to Caamano et al.

Figure 8:
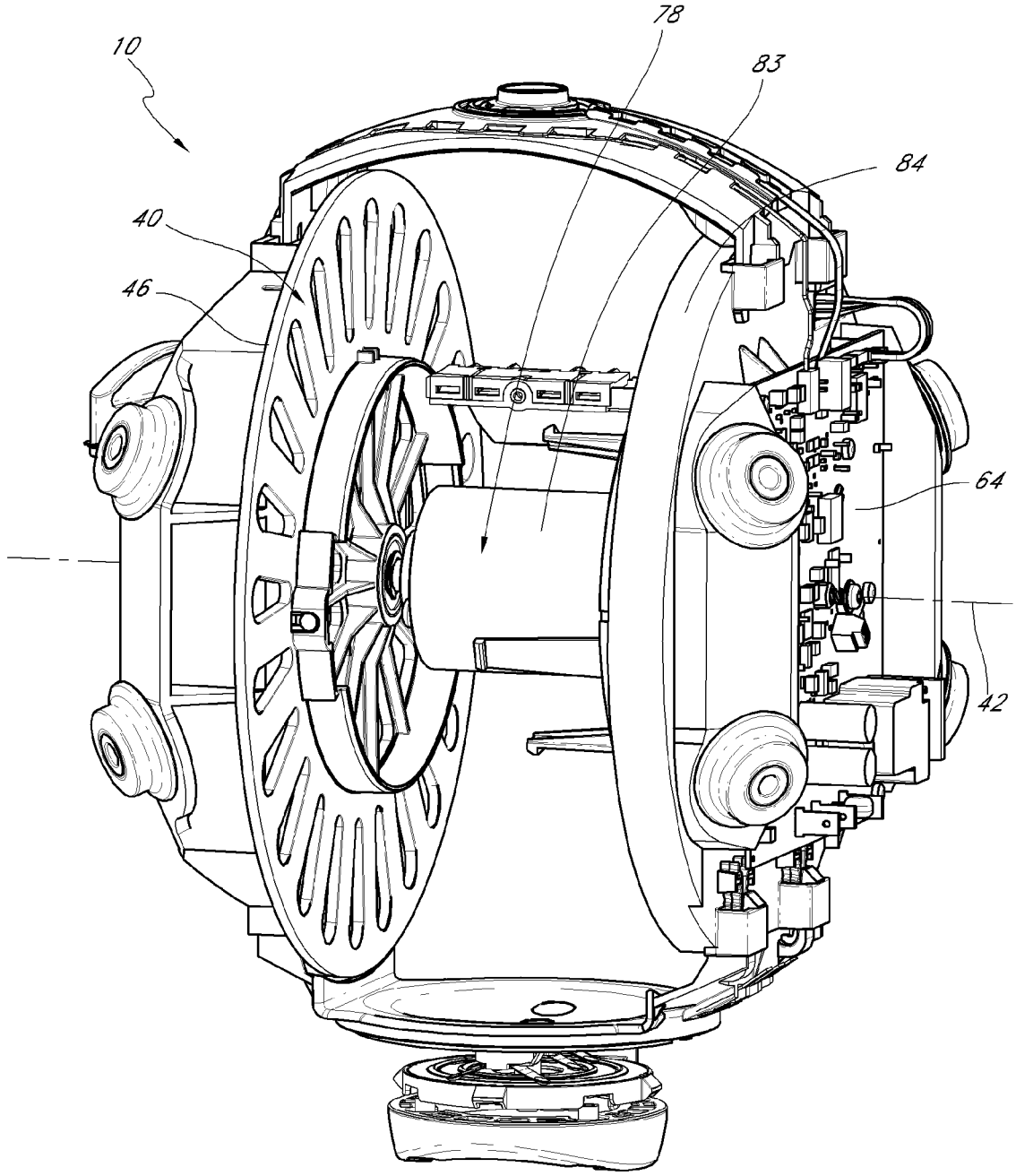
FIG. 8 is a front, right perspective view of the cord reel as shown in FIG. 5, with a portion of the rotatable member removed to show internal components.
Figure 9A:
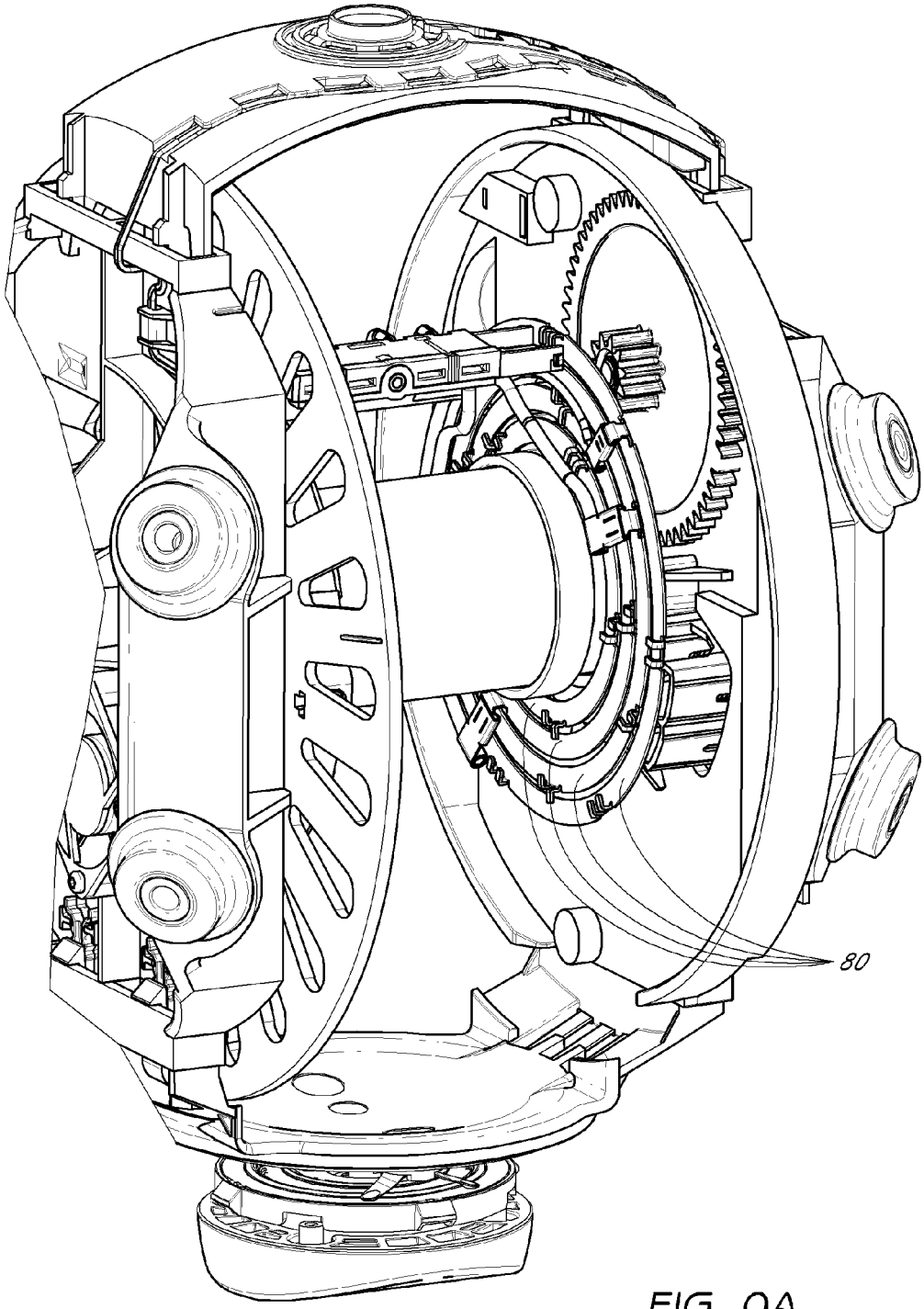
FIG. 9A is an expanded view of a portion of FIG. 9.

FIG. 8 is a front, right perspective view of the cord reel 10 as shown in FIG. 5, with the drum 44 (FIG. 2) of the rotatable member 40 removed to show internal components. In FIG. 8, the plate 48 (FIG. 2) is also removed. In the illustrated embodiment, a motor 78 is mounted within the drum 44 for powering the rotation of the rotatable member 40 about the winding axis 42. The motor 78 can comprise an electric motor that receives operation commands from the microchip 66 (FIG. 4) of the circuit board 64. Alternatively, the motor 78 can operate independently of the microchip 66. The motor 78 can be coupled with respect to the rotatable member 40 directly or via one or more intermediate gears (e.g., a gear reduction assembly). An embodiment of a gear assembly is provided in U.S. Pat. No. 7,533,843 to Caamano et al. The motor housing 83 can be fixed with respect to structure that is outside of one of the plates 46 and 48. For example, the housing 83 can be secured with respect to a plate 84 through an aperture within plate 48.

FIG. 9 is a front, left perspective view of the reel 10 as shown in FIG. 8. FIG. 9 shows a plurality of slip rings 80 that can be secured to the rotatable member 40. In this embodiment, the slip rings 80 are secured to an outer surface of the plate 48 (FIG. 2) of the rotatable member 40, such that the slip rings 80 and rotatable member 40 rotate together about the winding axis 42. Preferably, the slip rings 80 electrically communicate with the output power connector 54 (FIGS. 2, 2A, and 3). In some implementations, there are three slip rings 80, one each for ground, hot, and neutral signals of an AC power supply. In general, the use of slip rings is well known. Further details on the use of slip rings for an electrical cord reel are provided in U.S. Pat. No. 7,419,038 to Caamano et al.

Figure 10:
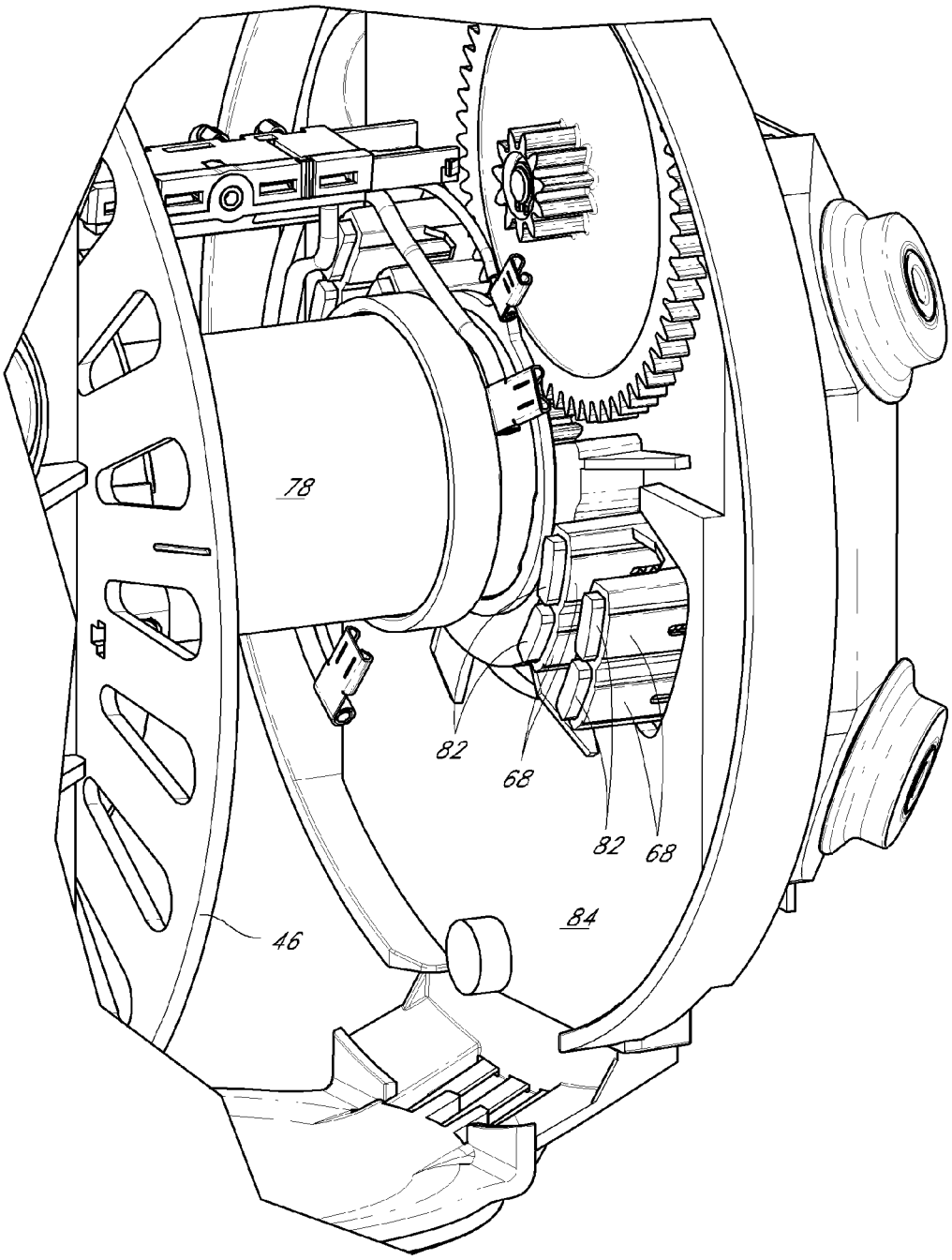
FIG. 10 is an exploded view of the cord reel as shown in FIG. 9, with the slip rings removed.

FIG. 10 is an exploded view of the cord reel 10 as shown in FIG. 9, with the slip rings 80 (FIG. 9) removed to show brushes 82 and the brush holders 68. The illustrated brush holders 68 are connected to the circuit board 64 (FIG. 5) and extend through the plate 84 of the reel 10. The brush holders 68 hold brushes 82 that form electrical connections with the slip rings 80 while the rotatable member 40 is either at rest or rotating about winding axis 42.

Figure 11:
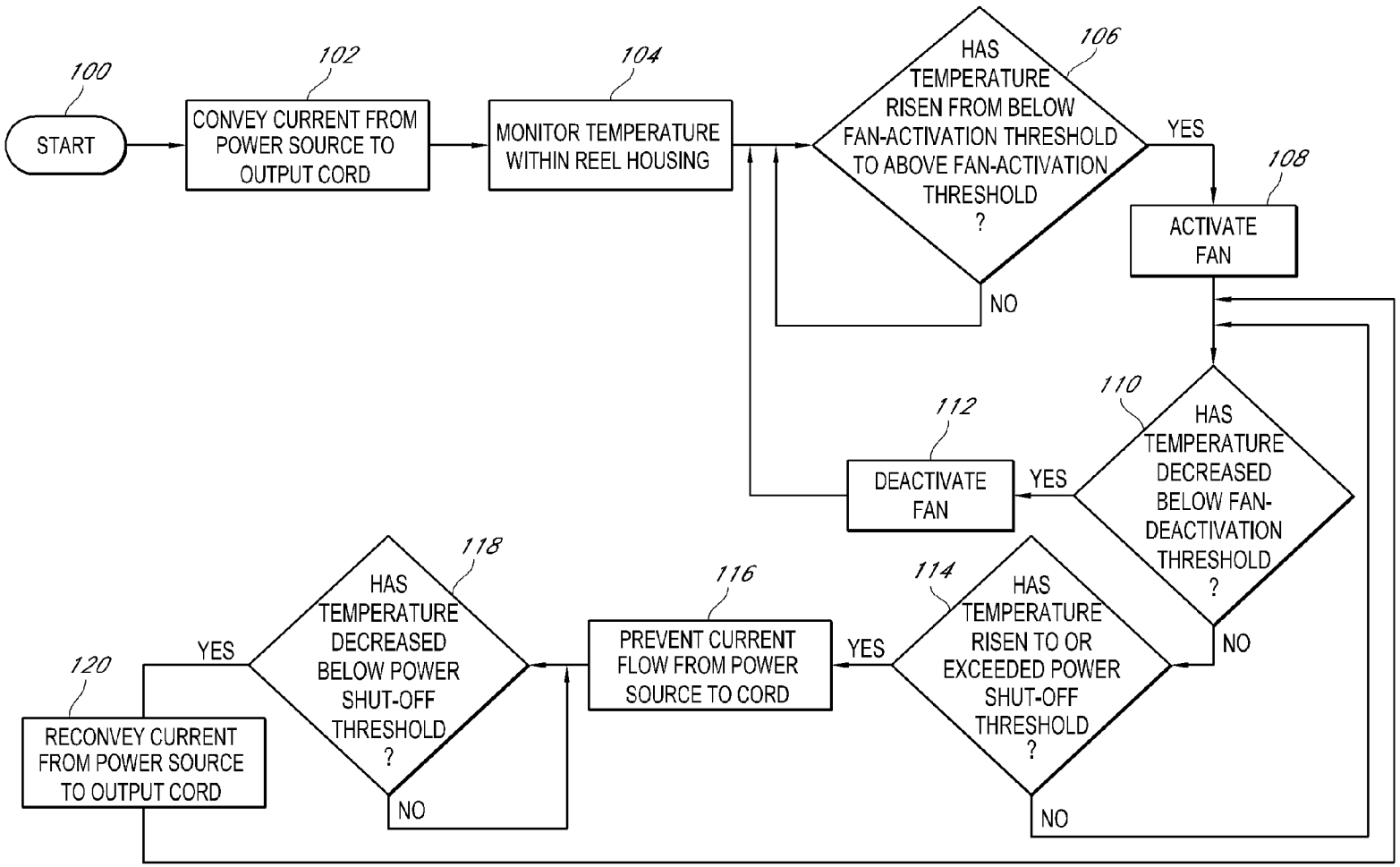
FIG. 11 is a flow chart of an embodiment of a method of controlling temperature within an electrical cord reel.

FIG. 11 is a flow chart of an embodiment of a method by which the control system 60 (FIG. 3) of the above-described reel 10 (FIG. 1) controls temperature within the reel housing 12. It will be appreciated that the sequence of the illustrated steps can differ from what is shown in FIG. 11. Further, it will be appreciated that this method can be employed by embodiments of electrical cord reels that are different than those described above.

The method begins at step 100, at which time a user attempts to use the reel 10 (FIG. 1) to draw electrical current from a power source 50 (FIG. 3), in order to electrically power a device 56 connected to the output cord 25 of the reel 10. In step 102, the reel 10 conveys electrical current from the power source 50 to the end of the output cord 25 that is mechanically and electrically coupled to the output power connector 54, so that the current flows through the cord 25. In step 102, the current can flow through an electrical pathway 55 that runs through a switch 52.

In step 104, the reel 10 (FIG. 1) monitors a temperature within the reel housing 12. For example, the reel 10 can employ a set of one or more temperature sensors 58 (FIGS. 3 and 4). If a plurality of temperature sensors 58 is provided, then the monitored temperature can comprise an average value of temperature levels detected by the temperature sensors. If the temperature sensor set 58 includes only one temperature sensor, then the monitored temperature can be the temperature reported by the single sensor, possibly offset by any known (e.g., empirically derived) temperature differences between the location of the sensor and any other location of interest within, on, or outside the reel housing 12. Step 104 can begin before or after step 102.

In decision step 106, the control system 60 (FIG. 3) determines if the monitored temperature (e.g., the temperature detected by the temperature sensor set 58) has risen from a level below a fan-activation threshold to a level above the fan-activation threshold but below a power shut-off threshold (the power shut-off threshold is preferably greater than the fan-activation threshold). If so, then the control system 60 responds by activating the fan 62 in step 108. If not, then the control system 60 returns to decision step 106, perhaps after a time delay.

After activating the fan 62 (FIG. 3) in step 108, the control system 60 determines in decision step 110 whether the monitored temperature has decreased from a level above the fan-activation threshold to a level below a fan-deactivation threshold, the fan-deactivation threshold being lower than the fan-activation threshold. If the control system 60 determines in decision step 110 that the monitored temperature is below the fan-deactivation threshold, then the control system 60 responds by deactivating the fan 62 in step 112, and then returning to decision step 106, perhaps after a time delay. If not, then the control system 60 proceeds to a decision step 114.

In decision step 114, the control system 60 (FIG. 3) determines whether the monitored temperature is greater than or equal to the power shut-off threshold. If so, the control system 60 responds by halting or preventing, in step 116, the current flow from the power source 50 to the output cord 25, for example by moving the switch 52 to its open position. If not, the method returns to decision step 110, perhaps after a time delay.

Figure 12:
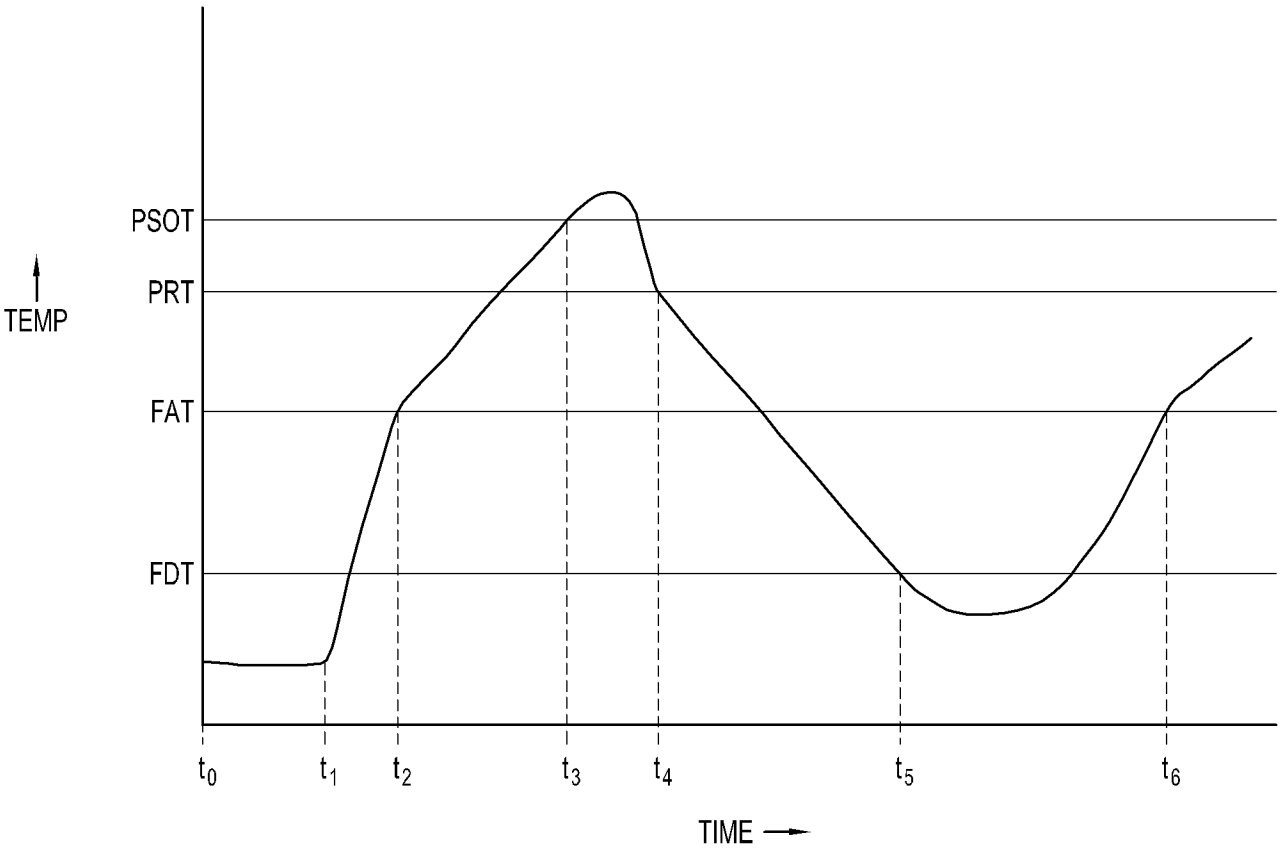
FIG. 12 is a graph showing an example of monitored temperature over time, in relation to a fan-deactivation threshold (FDT), a fan-activation threshold (FAT), a power shut-off threshold (PSOT), and a power-reactivation threshold (PRT).

After halting the current flow in step 116, the control system 60 (FIG. 3) determines, in decision step 118, whether the monitored temperature has decreased from a level above the power shut-off threshold to a level below the power shut-off threshold (or, as illustrated in FIG. 12, a power-reactivation threshold that is lower than the power shut-off threshold). If so, the control system 60 responds by reconveying electrical current, in step 120, from the power source 50 to the output cord 25, for example by moving the switch 52 from its open position to its closed position. After step 120, the method returns to step 110, perhaps after a time delay. If the control system 60 determines, in decision step 118, that the monitored temperature has not decreased below the power shut-off threshold, the method returns to decision step 118, perhaps after a time delay.

Preferably, the fan-activation threshold referred to in step 106 is greater than the fan-deactivation threshold referred to in step 110. This helps to prevent the fan 62 (FIGS. 3, 6, and 7) from quickly and repeatedly turning on and off as the monitored temperature repeatedly rises above and falls below a single threshold. In like manner, two separate power enablement thresholds (as opposed to just a power shut-off threshold) can be defined to prevent repeated opening and closing of switch 52. Accordingly, in an alternative embodiment (an example of which is illustrated in FIG. 12), the control system 60 is configured to begin reconveying the electrical current (after it was halted in step 116 of FIG. 11) only after the monitored temperature drops below a power-reactivation threshold that is lower than power shut-off threshold. In other words, decision step 118 of FIG. 11 could determine whether the monitored temperature has decreased below a power-reactivation threshold that is lower than power shut-off threshold.

FIG. 12 is a graph showing an example of monitored temperature over time, in relation to a fan-deactivation threshold (FDT), a fan-activation threshold (FAT), a power shut-off threshold (PSOT), and a power-reactivation threshold (PRT), achieved by using an embodiment of a temperature control system 60 (FIG. 3). It will be appreciated that the shape and magnitude of the temperature curve depends upon the ambient temperature, the values of the temperature thresholds (FDT, FAT, PSOT, and PRT), the magnitude and variation over time of the electrical current being drawn by one or more devices 56, the thermal properties of the output cord 25 and reel 10, the amount of cord 25 that is wound and located within the reel housing 12 (FIG. 1), the control system 60 program or methodology, and other factors.

The illustrated example begins at time $t_0$, at which time there are no powered devices 56 (FIG. 3) drawing any electrical current through the output electrical cord 25. At time $t_1$, at least one device 56 begins drawing current. In this example, from time $t_0$ to time $t_1$, the temperature monitored by the control system 60 remains fairly constant. After time $t_1$, the monitored temperature begins to rise, perhaps sharply, due to the dissipation of heat from the cord 25 caused by current flow through the cord 25. It will be appreciated that the heat dissipated from any portion of the cord 25 that is outside of the reel housing 12 (FIG. 1) does not significantly affect the monitored temperature if the sensors 58 are inside the housing 12. Heat dissipated from the portion of cord 25 enclosed within the housing 12 is believed to be the primary cause of heightened temperature detected by sensors 58 enclosed within the housing 12.

At time $t_2$, the monitored temperature rises above the fan-activation threshold. In certain embodiments, this causes the control system 60 to activate the fan 62 (FIGS. 3, 6, and 7). The fan activation can cause the monitored temperature to rise more gradually, to remain steady, or to decrease. In the illustrated example, after time $t_2$ the monitored temperature continues to rise (albeit more gradually) until it reaches the power shut-off threshold at time $t_3$. The control system 60 preferably responds to the temperature reaching the power shut-off threshold by halting current flow to the cord 25. The cessation of current flow causes a decline in heat dissipation from the cord 25, which in turn causes the monitored temperature to begin increasing more gradually before eventually decreasing, or alternatively to begin decreasing immediately. In the illustrated example, the monitored temperature decreases until it reaches the power-reactivation threshold at time $t_4$. When the monitored temperature drops below the power-reactivation threshold after time $t_4$, the control system 60 preferably begins reconveying electrical current to the powered device(s) 56. This may cause the monitored temperature to begin rising again, or alternatively to continue decreasing, albeit at a more gradual rate. For example, the fan operation over time can result in a net cooling effect inside the reel housing 12.

In the illustrated example, the monitored temperature decreases until it reaches the fan-deactivation threshold at time $t_5$. The control system 60 preferably deactivates the fan 62 at time $t_5$. The cessation of fan operation can cause the temperature to continue dropping (albeit more gradually), hold steady, or begin rising (after initially beginning to decrease more gradually). In the illustrated example, the monitored temperature rises after time $t_5$ until it reaches the fan-activation threshold at time $t_6$. Similarly to its response at time $t_2$, the control system 60 preferably responds to the monitored temperature reaching the fan-activation threshold at time $t_6$ by reactivating the fan 62. The method then proceeds as described above.

Figure 13:
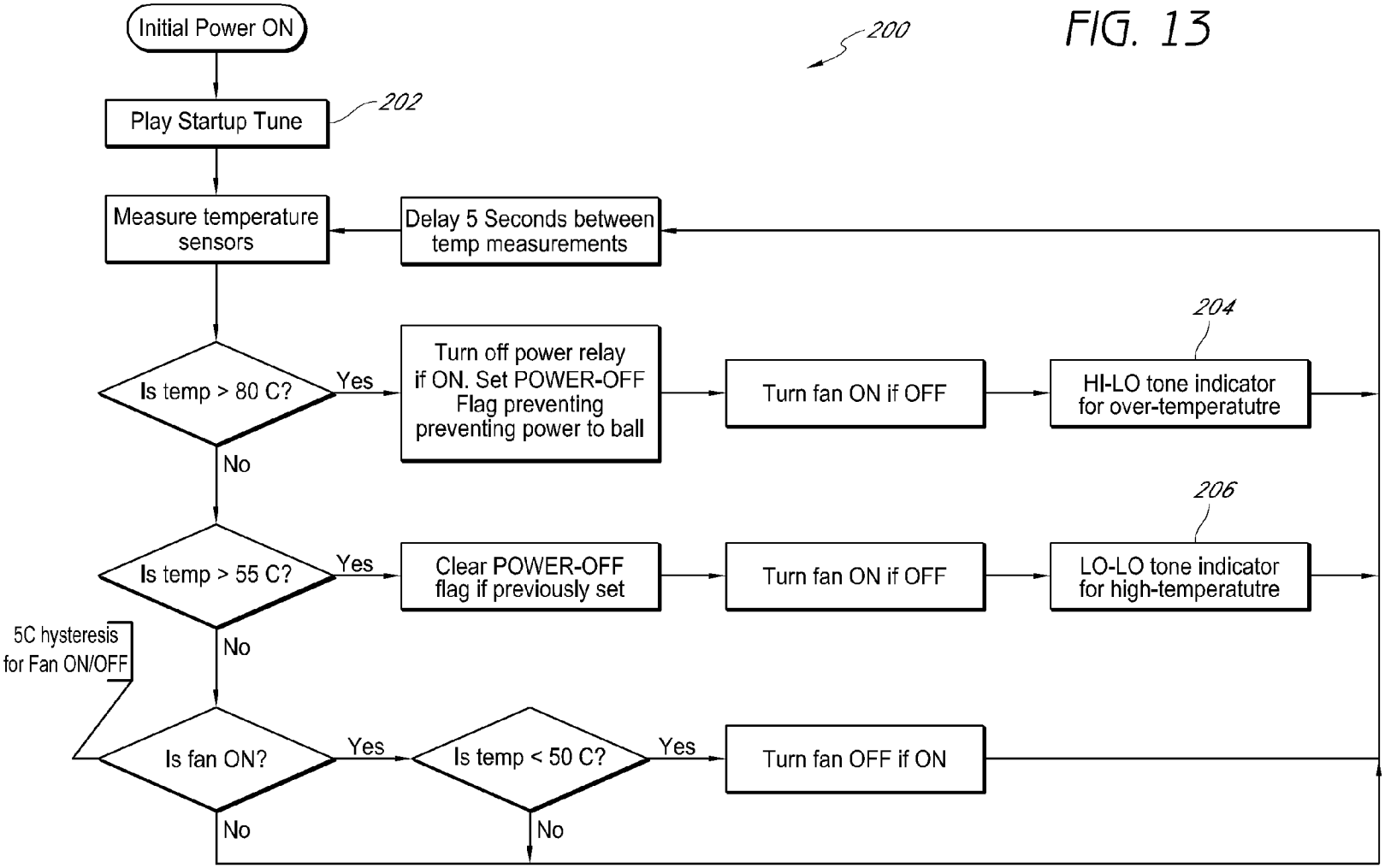
FIG. 13 is a flow chart of another embodiment of a method of controlling temperature within an electrical cord reel.

FIG. 13 is a flow chart of another embodiment of a method by which the control system 60 (FIG. 3) of the above-described reel 10 (FIG. 1) controls temperature within the reel housing 12. The illustrated method 200 differs from that described of FIG. 11 in a few ways. One difference is that the reel plays an audible startup tune 202 when the unit is activated. In other embodiments, the reel alternatively or additionally generates a visual indicator (e.g., lights, video, etc.). Another difference is that the method 200 includes generating visual and/or audible indicators of the temperature status of the reel. An indicator 204 can be generated if the temperature is greater than the power shut-off threshold, and an indicator 206 can be generated if the temperature is less than the power shut-off threshold but greater than the fan-activation threshold. It will be understood that the method 200 can use different temperatures and time delays than the values shown in FIG. 13.

In certain embodiments, the fan 62 (FIGS. 3, 6, and 7) is configured to be operated at different speeds, resulting in different available levels of cooling. In such embodiments, a plurality of different fan-activation thresholds can be defined, corresponding to the different fan speeds. For example, the control system 60 can be configured to increase the fan speed every time the monitored temperature rises above a different fan-activation threshold. Similarly, a plurality of different fan-deactivation thresholds can be defined, and the control system 60 can be configured to decrease the fan speed every time the monitored temperature drops below a different fan-deactivation threshold. In some embodiments, the fan speed varies continuously (while increasing and/or decreasing) as the temperature changes.

In certain embodiments, a remote control for controlling the motor 78, switch 52, and/or fan 62 is provided. The remote control can be handheld. It can be configured to be selectively attached to and detached from the output cord 25, at the option of a user. Alternatively, the remote control can be integrated with the cord 25 in a manner that is inconsistent with repeated attachment and detachment with respect to cord 25. For example, the remote control can be integrated with the end portion 24 (FIG. 1) of the output cord 25, and can include an interface 27, such as one or more buttons for controlling the motor 78, switch 52, and/or fan 62. The remote control can send control signals wirelessly or through a hardwire connection running through the cord 25. If wireless, the remote control can be paired with a wireless receiver mounted on the circuit board 64. The wireless receiver and associated electronic components can relay the wireless command signals to the motor 78, switch 52, and/or fan 62. Further details concerning remote controls for operating reels are provided in U.S. Pat. No. 7,503,338 to Harrington et al. and U.S. patent application Publication No. 2008/0223951A1 to Tracey et al.

In certain embodiments, the reel 10 includes a motor controller that controls the motor 78. For example, the motor controller can be configured to activate the motor 78 in response to command signals from a remote control. In such embodiments, the motor controller can comprise components mounted on the circuit board 64. The motor controller and possibly a tension detector can be configured to detect a high-tension condition of the cord 25 (e.g., a state in which the tension exceeds a defined threshold), which may be due to a user pulling the cord 25. The motor control can be configured to respond to a detection of the high-tension condition by activating the motor 78 to unwind the cord 25. This is referred to as "powered assist." Further, the motor controller can be configured to monitor the amount of cord 25 that is unwound from the rotatable member 40. When completely rewinding the cord 25, the motor controller can be configured to reduce the rewind speed while rewinding a terminal portion of the cord 25, to prevent wild or unpredictable movements of the cord 25 and reduce the risk of damage or injury. This feature is referred to as "docking." Further details concerning a motor controller are provided in U.S. Pat. No. 7,350,736 to Caamano et al.

In certain embodiments, the reel 10 (FIG. 1) includes a user interface located on or near the housing 12 or support structure 18, for controlling the motor 78, switch 52, and/or fan 62. In the illustrated embodiment, the reel 10 includes a user interface 29 at the top of the housing 12. The illustrated user interface 29 is wired to the circuit board 64 via a connection 65. In one implementation, the user interface 29 comprises a control (e.g., a button) that, when activated, toggles the reel 10 between a rewind state and an at-rest state. In the rewind state, the reel 10 operates the motor 78 to rewind the output cord 25. In the at-rest state, the reel 10 either does not operate the motor 78 or operates it to prevent wind or unwind rotation of the rotatable member 40. In alternative embodiments, the user interface 29 can comprise a plurality of controls for various functions of the reel.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while several variations of the invention have been shown and described in detail, other modifications, which are within the scope of this invention, will be readily apparent to those of skill in the art based upon this disclosure. It is also contemplated that various combinations or sub-combinations of the specific features and aspects of the embodiments may be made and still fall within the scope of the invention. It should be understood that various features and aspects of the disclosed embodiments can be combined with, or substituted for, one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An electrical cord reel comprising:

a rotatable member configured to rotate about a winding axis to spool and unspool a linear material about the rotatable member;

an input power connector configured to be mechanically and electrically coupled to an electrical power source;

an output power connector on the rotatable member, the output power connector configured to be mechanically and electrically coupled to an electrical cord that is at least partially wound about the rotatable member, the reel configured to convey electrical current from the input power connector to the output power connector;

a fan;

a switch having a closed position in which electrical current flows from the input power connector to the output power connector through the switch, the switch having an open position in which the switch prevents electrical current from flowing from the input power connector to the output power connector;

a housing enclosing the rotatable member, the output power connector, and the fan;

a set of one or more temperature sensors configured to detect temperature inside the housing; and a control system responsive to the temperature detected by the temperature sensor set, the control system configured to activate the fan if the temperature detected by the temperature sensor set rises from a level below a fan-activation threshold to a level above the fan-activation threshold but below a power shut-off threshold, the power shut-off threshold being greater than the fan-activation threshold, the control system configured to move the switch to its open position if the temperature detected by the temperature sensor set is greater than or equal to the power shut-off threshold.

2. The reel of claim 1, wherein the control system is configured to move the switch from its open position to its closed position if the temperature detected by the temperature sensor set decreases from a level above the power shut-off threshold to a level below the power shut-off threshold.

3. The reel of claim 1, wherein the control system is configured to deactivate the fan if the temperature detected by the temperature sensor set decreases from a level above the fan-activation threshold to a level below a fan-deactivation threshold, the fan-deactivation threshold being lower than the fan-activation threshold.

4. The reel of claim 1, further comprising a motor adapted to rotate the rotatable member about the winding axis.

5. The reel of claim 4, wherein the housing encloses the motor and the temperature sensor set.

6. The reel of claim 1, wherein the temperature sensor set comprises a plurality of temperature sensors, the temperature detected by the temperature sensor set comprising an average value of temperature levels detected by the temperature sensors.

7. The reel of claim 1, wherein the temperature sensor set includes only one temperature sensor.

8. The reel of claim 1, wherein the housing has an aperture through which an electrical cord may extend when partially wound about the rotatable member.

9. A method comprising:

providing a rotatable member configured to rotate about a winding axis to spool and unspool an electrical cord about the rotatable member, an end of the cord being electrically connected to the rotatable member;

providing a housing enclosing the rotatable member;

conveying electrical current from an electrical power source to the end of the cord, so that the current flows through the cord;

monitoring a temperature within the housing;

responding to a rise of the monitored temperature from a level below a fan-activation threshold to a level above the fan-activation threshold but below a power shut-off threshold by activating a fan inside the housing, the power shut-off threshold being greater than the fan-activation threshold; and responding to a rise of the monitored temperature to a level greater than or equal to the power shut-off threshold by preventing current flow from the power source to the cord.

10. The method of claim 9, further comprising responding to a decrease of the monitored temperature from the power shut-off threshold to below the power shut-off threshold by reconveying electrical current from the electrical power source to the cord.

11. The method of claim 9, further comprising responding to a decrease in the monitored temperature from a level above the fan-activation threshold to a level below a fan-deactivation threshold by deactivating the fan, the fan-deactivation threshold being lower than the fan-activation threshold.

12. The method of claim 9, wherein monitoring the temperature comprises monitoring output signals produced by a plurality of temperature sensors inside the housing, the temperature comprising an average value of the signals detected by the temperature sensors.

13. The method of claim 9, wherein monitoring the temperature comprises monitoring an output signal of only one temperature sensor inside the housing.

* * * * *